US005468049A

United States Patent [19]

Johnston

[11] Patent Number: 5,468,049

[45] **Date of Patent: * Nov. 21, 1995**

[54] MANUALLY OPERATED UPLIFT APPARATUS

[76] Inventor: Gary L. Johnston, P.O. Box 183, Cowarts, Ala. 36321

[ * ] Notice: The portion of the term of this patent subsequent to Apr. 19, 2011, has been disclaimed.

[21] Appl. No.: 226,353

[22] Filed: Apr. 12, 1994

Related U.S. Application Data

[63] Continuation-in-part of Ser. No. 759,233, Sep. 13, 1991, Pat. No. 5,303,982, and a continuation-in-part of Ser. No. 144, 034, Nov. 1, 1993.

[51] Int. Cl.[6] ..... A47C 3/30

[52] U.S. Cl. ..... 297/339

[58] Field of Search ..... 297/339, 338, 297/337, DIG. 10, 411.3, 323; 4/560.1, 564.1, 565.1

[56] References Cited

U.S. PATENT DOCUMENTS

| | | | |
|---|---|---|---|
| 459,282 | 9/1891 | Gollon | 297/DIG. 10 |
| 2,788,527 | 4/1953 | Steven | 297/DIG. 10 |
| 2,850,075 | 4/1956 | Wilson | 155/30 |
| 4,034,426 | 7/1977 | Hardwick et al. | 4/185 L |
| 4,888,833 | 12/1989 | Garcia et al. | 4/480 |
| 4,907,303 | 3/1990 | Baird | 4/480 |
| 4,929,022 | 5/1990 | Geraci | 297/313 |
| 5,303,982 | 4/1994 | Johnston | 297/339 |

FOREIGN PATENT DOCUMENTS

| | | |
|---|---|---|
| 1435559 | 4/1974 | United Kingdom . |
| 2183150 | 6/1987 | United Kingdom . |

*Primary Examiner*—James R. Brittain

[57] ABSTRACT

A manually operated uplift apparatus comprising a structural frame unit, a mechanical uplift assembly unit, and a power translating mechanism connecting the two units to allow the user to more easily obtain a standing position from a previously seated position. The structural frame unit is used to support and guide the mechanical uplift assembly unit. The mechanical uplift assembly unit has two sections which can independently move vertically with respect to the structural frame unit. One section has a seat, the other has rails. When downward force is applied to the rails, the section having the rails moves vertically downward and produces an upward force in the section having a seat through the power translating mechanism. This interface allows the user to more easily uplift themselves from a seated position and is especially useful for older and/or medically disabled persons.

11 Claims, 6 Drawing Sheets

MANUALLY OPERATED UPLIFT APPARATUS

CROSS-REFERENCED TO RELATED APPLICATIONS

This application is a Continuation-In-Part of U.S. Ser. No. 07/759,233, now U.S. Pat. No. 5,303,982, filed Sep. 13, 1991 and issued on Apr. 19, 1994 and U.S. application Ser. No. 08/144,034, filed on Nov. 1, 1993.

BACKGROUND OF THE INVENTION

1. Field of the Invention

The present invention relates to a mechanical sitting device. More particularly, the present invention relates to a sitting device from which the user may mechanically uplift themselves from a seated position to a point where a standing position may be more easily obtained.

2. Description of the Prior Art

Sitting devices designed to assists the user in obtaining a standing position from a previously seated position are known in the art. Conventionally, these sitting devices are relatively expensive, bulky, and weighty, making them difficult to move from place to place. Further, many of these devices use electrical power to uplift the user, therefore requiring proximity to electrical outlets, or the extra weight of batteries.

U.S. Pat. No. 459,282 to Gollon discloses an exercise apparatus which has a frame unit, uplift assembly, vertical support members, structural pulleys, guide elements, a seat member, rail members, a cable member, and a back support. The arrangement and interaction of these elements and the resultant device is unrelated to the present invention.

U.S. Pat. No. 2,788,527 to Steven discloses a bathtub which can be electrically raised and lowered between two walls using rollers and attached mercerized canvas.

U.S. Pat. No. 2,850,075 to Wilson discloses an invalid chair including a vertically adjustable carriage assembly. This carriage assembly is raised and lowered between supports through the use of a sling which can be lengthened or shortened using power means and a crank.

U.S. Pat. No. 4,034,426 to Hardwick et al. discloses a mechanical bath tub lift chair apparatus wherein the user rocks the chair to elevate the seat through a ratchet system.

U.S. Pat. No. 4,888,833 to Garcia et al. discloses a cart for positioning a body on a toilet, having hydraulic means for lifting and lowering a seat means.

U.S. Pat. No. 4,907,303 to Baird discloses an orthopedic chair with a spring loaded pivoting seat.

U.S. Pat. No. 4,929,022 to Geraci discloses a chair, with a spring loaded pivoting seat, having a lifting means comprised of handle bars and a foot operated lever member.

U.K. Patent GB 1,435,559 discloses a chair including a motorized seat which can be raised and lowered wihtout tilting relative to a base.

Published U.K. Patent Application GB 2,183,150 A discloses a chair including a seat which tilts forward when actuated by the user through pivotally attached tilting means.

None of the above invention and patents, taken either singly or in combination, is seen to describe the instant invention as claimed.

SUMMARY OF THE INVENTION

The present invention comprises a manually operated uplift apparatus which includes a sitting device from which the user is uplifted from a seated position by pushing downward upon a set of rails or hand engagement handles, producing downward motion of said rails or hand engagement handles. This downward motion creates upward motion in a seat, to achieve a raised position. This raised seat position allows the user to more easily achieve an upright standing position.

Accordingly, it is a principle object of the invention to provide a mechanical user-powered seat uplift apparatus which may be easily operated by persons who normally have difficulty in standing from a seated position.

It is another object of the invention to provide sitting devices adaptable to any conventional use of seats, including toilets, wheelchairs, airplane seats, and stationary chairs.

These and other objects of the present invention will become readily apparent from further review of the following specification and drawings.

BRIEF DESCRIPTION OF THE DRAWINGS

FIG. 5A is a side view of a typical chair structure incorporating the manually operated uplift apparatus.

DETAILED DESCRIPTION OF THE PREFERRED EMBODIMENT

Figure 1A:
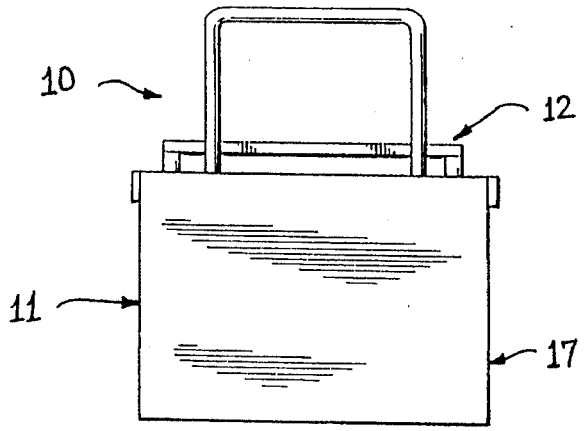
FIG. 1A is a side view of the manually operated uplift apparatus while in a disengaged position.
Figure 1B:
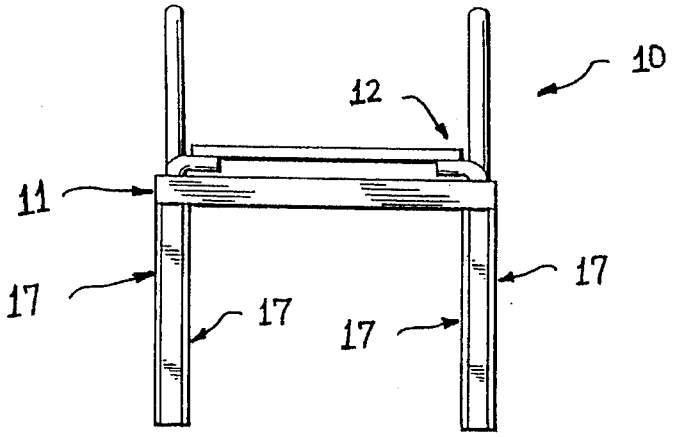
FIG. 1B is a front view of the uplift apparatus while in a disengaged position.
Figure 1C:
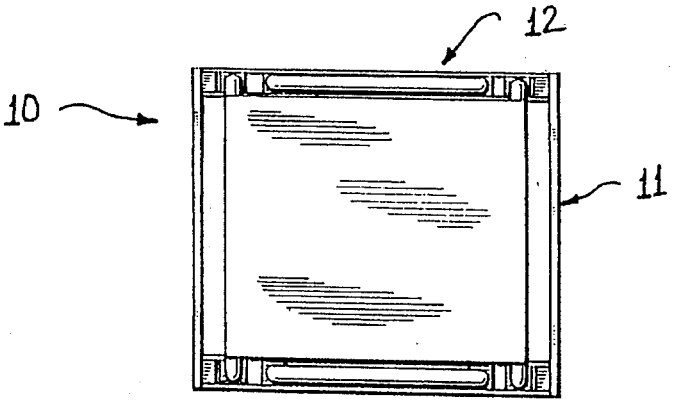
FIG. 1C is a top view of the uplift apparatus while in a disengaged position.
Figure 2A:
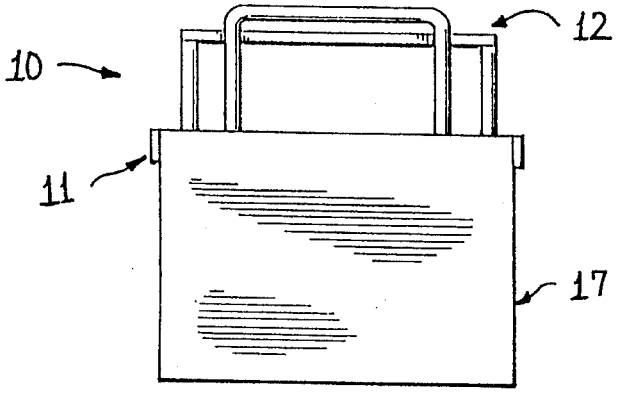
FIG. 2A is a side view of the manually operated uplift apparatus while in an engaged position.
Figure 2B:
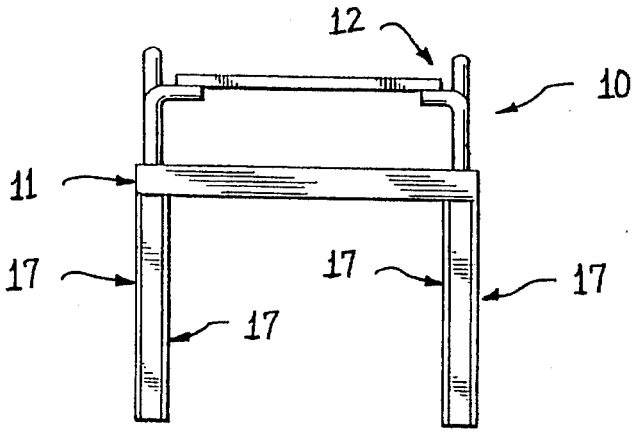
FIG. 2B is a front view of the uplift apparatus while in an engaged position.
Figure 2C:
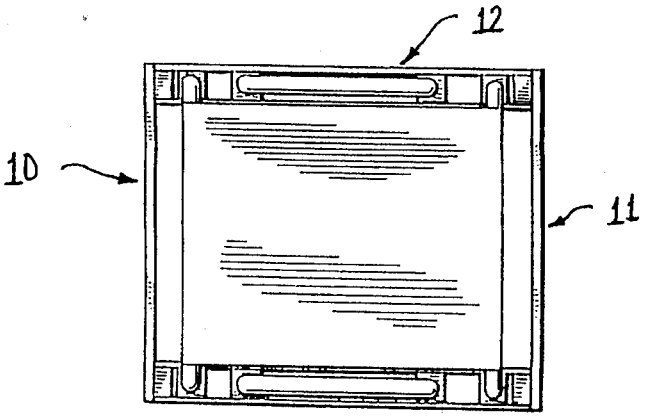
FIG. 2C is a top view of the uplift apparatus while in an engaged position.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description, and not limitation.

As can be seen by reference to the drawings, and in particular FIGS. 1A–4B, the manually operated uplift apparatus that forms the basis of the present invention is designated generally by the reference numeral 10, and comprises a structural frame unit with frame 11, a mechanical uplift assembly unit 12, and a power translating mechanism 20.

The structural frame unit comprises a frame 11, composed of vertical support members 13 and horizontal support members 14; mechanism engagement means 15 for engaging the power translating mechanism; and optionally, guide elements 16.

The mechanical uplift assembly unit 12 comprises a seat 21 mounted to a first member 22, which supports the user while in a substantially horizontal seated position, and rails or hand engagement handles 23 disposed on each side of the seat, and mounted to a second member 24, wherein each member has mechanism engagement means 27 for engaging the power translating mechanism 20, and is moveable in the substantially vertical direction independent of the other member, with respect to the structural frame unit. The mechanical uplift apparatus may optionally further comprise guide elements 16.

The power translating mechanism 20 operatively connects said first member, said second member, and said frame through their respective mechanism engagement means such that the downward force on said rails or hand engagement handles translates to upward forces on said seat. Therefore, as the rails or hand engagement handles move downward, the seat will move upward.

The frame of the structural frame unit comprises vertical support members 13 and horizontal support members 14. The frame may optionally further comprise side plates 17. Additional horizontal support members 14 may extend along the side of the device and serve the same purpose as the side plates 17. However, using a side plate does encloses the assembly which should prove desireable. Said vertical support members, said horizontal support members, and optionally said side plates together form a rigid structure. This may be accomplished by any appropriate arrangement such as unitary construction, jointed construction between said horizontal support members and said vertical support members, or braced construction between said horizontal support members, said vertical support members, and said side plates.

The mechanism engagement means 15 of the structural frame unit may be a structural feature of said frame, and can be holes, grooves, sleeves, brackets, bolts, pins, and hooks therein. In FIGS. 1A–4B, the structural frame unit comprises side plates placed between, and attached to, two horizontal support members 14 of the frame 11. Therein, the mechanism engagement means 15 are pins attached to and supported by said plates.

The optional guide elements 16 of the structural frame unit may also be a structural feature of the frame 11 or, alternatively, are attached to said frame, any may optionally further comprise rollers or low friction coating. These guide elements receive the vertical support elements of the mechanical uplift assembly unit. Preferred guide elements include sleeves or grooves. As seen in FIGS. 3A–4B, the guide elements 16 are sleeves attached between two side plate members of said frame 11 or alternatively, two horizontal support members of said frame 11.

The seat 21 of the mechanical uplift assembly unit has appropriate features for the intended use of the present device. For example, when the present device is incorporated into a toilet, such as shown in FIG. 5B, the conventional features of toilet, seats, such as a central void, are incorporated. Preferably, the seat further comprises a back support, such as shown in FIGS. 5A, 28, and 5C, 32. The seat is preferrably made of lightweight materials such as cloth, lightweight metals, plastic, or combinations thereof.

Said seat 21 is mounted to a first member 22, which comprises at least one substantially vertical support element of substantially constant horizontal dimension, and means for supporting said seat. Said means for supporting said seat are any appropriate means which fixedly attach seat 21 to said first member 22, including adhesive, brackets and screws, or the like.

Preferrably said first member comprises two or more vertical support elements. Optionally, said first member may further comprise a horizontal support element. The vertical support elements, means for supporting said seat, and optional horizontal elements are arranged by any appropriate manner, such as unitary construction, jointed construction, or the like, such that the first member is substantially rigid. The first member comprises a mechanism engagement means 27, which may be of the same type used in the structural frame unit, and may be a structural feature of said first member, or may be separately attached.

Rails or hand engagement handles 23 are disposed on each side of said seat which are mounted to a second member 24, wherein said second member comprises at least one substantially vertical support element of constant horizontal dimension. As with the first member, the second member may further comprise optional horizontal support elements, and is substantially rigid. A mechanism engagement means 27, which may be of the same type used in the structural frame unit, is a structural feature of said second member, or is separately attached.

Figure 3A:
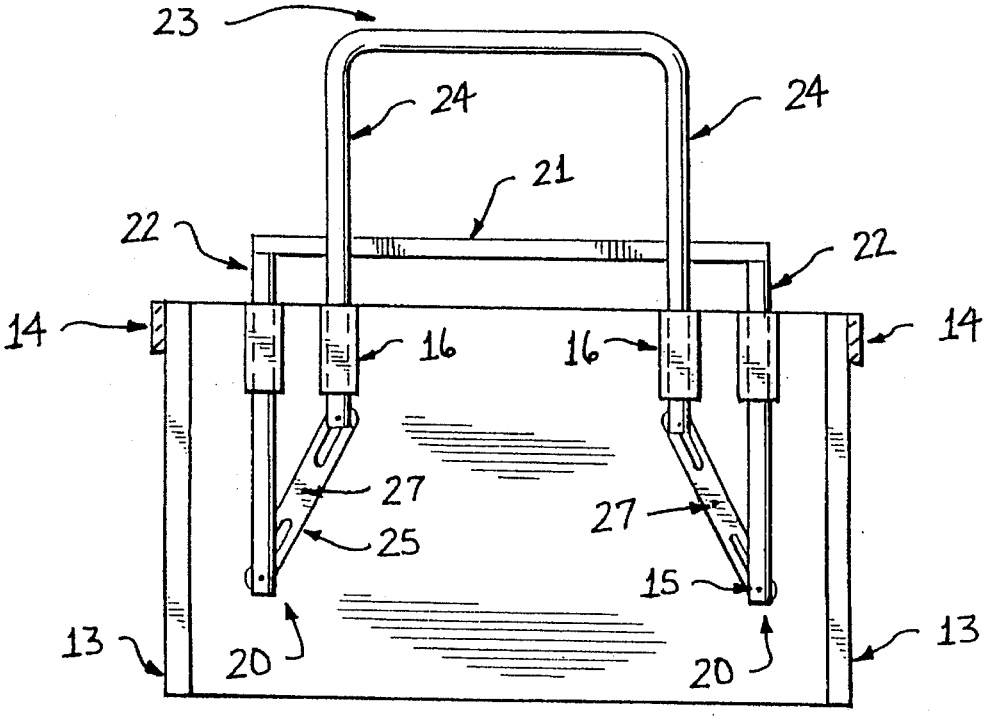
FIG. 3B is a side view of one embodiment of the mechanical uplift assembly unit while in an engaged position.
Figure 3B:
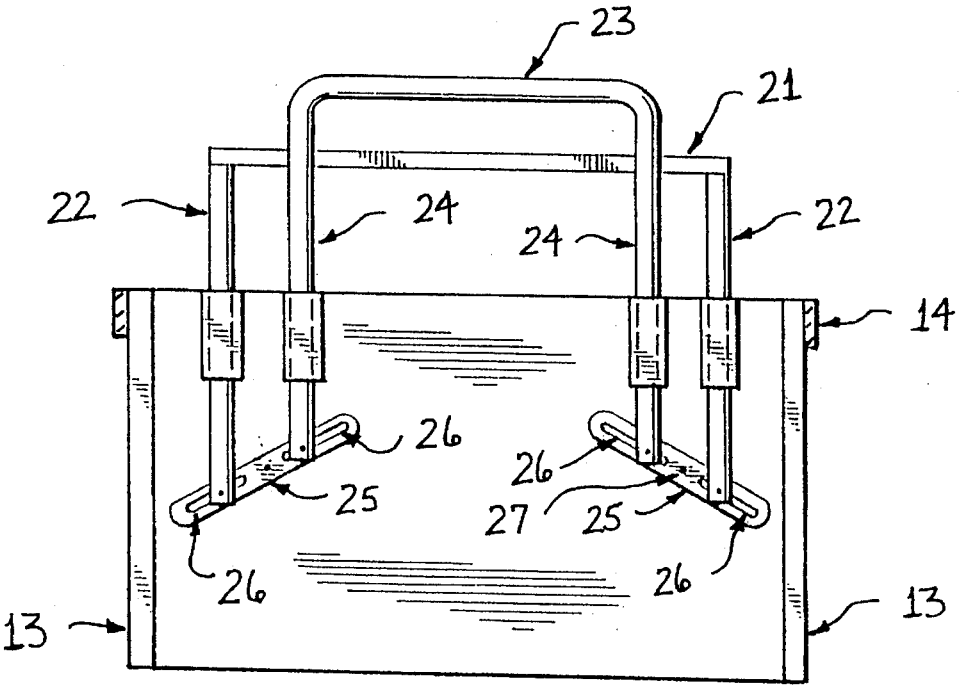

The power translating mechanism 20 operatively connects said first member, said second member, and said frame through their respective mechanism engagement means such that the downward force on said rails or hand engagement handles 23 translates to upward force on said seat 21. This may be accomplished through various power transfer schemes. Preferrably, the power translating mechanism 20 comprises a linkage system wherein a rigid linkage element 25 is rotated about a fixed axis, said axis being supplied by a mechanism engagement means 27 fixed to said frame. This is shown in FIGS. 3A–3B. Two elongated slots 26 exist in said linkage element, which are radial from said axis, and are located on each side of said axis. Each of said first member and said second member have pins as mechanism engagement means 27 which slideably fit within said elongated slots of said linkage system. As shown, linkage elements 25 are symmetrical in design and the first member 22 and second member 24 connect to the linkage element at a proximate equal distance from the linkage center of rotation. Therefore the ratio of seat 21 travel distance to hand engagement handle 23 travel distance will be approximately one. Ratios other than this may be obtained if the connection distances from the center of rotation are not equal.

Figure 4A:
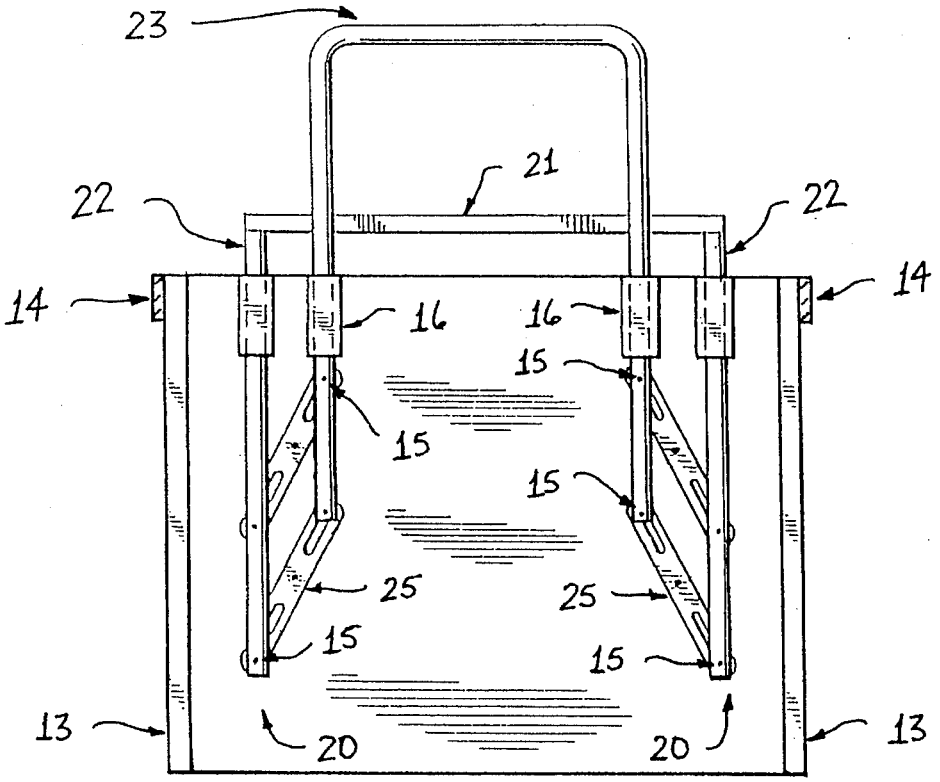
FIG. 4A is a side view of a second embodiment of the mechanical uplift assembly unit while in a disengaged position.
Figure 4B:
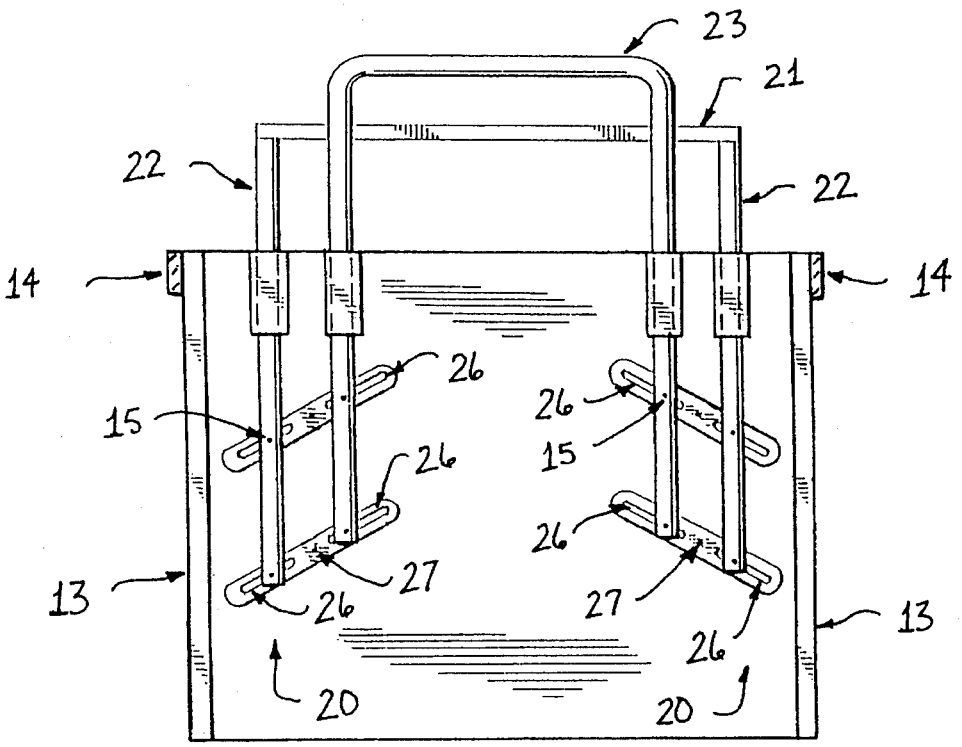
FIG. 4B is a side view of a second embodiment of the mechanical uplift assembly unit while in an engaged position.

FIGS. 4A–4B demonstrate an additional linkage element 25 which also rotates about a fixed axis, said axis also being a pin type of mechanism engagement means 27. This additional linkage element also connects the first and second members and, in conjunction with the original linkage element, keeps the first and second members substantially parallel to one another. The additional linkage element will thus not only act as a force transfer element, but also assist said guide elements in guiding the first and second members in the substantially vertical direction.

Alternatively, the power translating mechanism may comprises a linkage system utilizing a cable or tether. Accordingly, the mechanism engagement means of two of group selected from said first member, said second member, and said frame are pulleys. The third of the group would have, as mechanism engagement means, grips, holes or grooves, which would hold the two ends of the tether or cable. The said tether or cable operatively connects: the first member through a mechanism attachment means of the hole or grip type, the second member through pulleys, and the frame through pulleys. Different configurations may be used to produce different ratios of first member travel and second member travel, in the vertical direction.

Previous U.S. application Ser. No. 07/759,233 and U.S. application Ser. No. 08/144,034, of which this is a C-I-P, is herein incorporated by reference wherein these alternative linkage systems are further described. The invention has the advantage of utilizing other embodiments of power transfer mechanisms and mechanism engagement means which are available in the art, so long as the transfer of downward motion of the second member is translated to the upward motion of the first member.

The seat 21 attached to said first member 22 must maintain a substantially horizontal position through said upward motion of said first member. This is also true for the rail or hand engagement handle 23 and the second member 24. This may be accomplished in many different ways, as demonstrated by previous U.S. application Ser. No. 08/144,034. Preferrably, the first and second members may utilize guide elements 16, which are mounted on frame 11 for guidance. The first and second members move through these guide elements in order to maintain the desired substantially vertical direction of movement. Alternatively, guide elements may be mounted on the frame and on the first and/or second members. This would enable the first and second members to utilize one another for guidance, in some combination with the frame.

The preferred embodiment utilizing optional guide elements 16 may be seen in FIGS. 3A–4B. The optional guide elements of the structural frame unit may be a structural feature of the frame 11, or, alternatively, are attached to said frame, and may optionally further comprise rollers or low friction coating. These guide elements receive the first and second members of the mechanical uplift assembly unit. Preferably, guide elements 16 include sleeves or grooves extending vertically between the two side plates or horizontal members. The first and second members would thus slide within the sleeves or grooves and maintain a substantially vertical direction of movement. Since the sleeves or grooves loosely receive said first and second members, there may be instances where the first and second members are not in contact with the sleeves or grooves, but are moving freely. Therefore the guiding elements 16 may not always be used. In either case, the first and second members will move through the sleeves or grooves in a smooth and effortless manner.

As demonstrated in FIGS. 1A–4B, a user may push downward upon rail or hand engagement handles 23, and the handle will move in a substantially downward direction, as guided by the optional guide elements and/or linkage elements. The power translating mechanism translates this downward force and motion of the handle into an upward force and motion of the seat. The seat will move in the upward direction as guided by the optional guide elements and/or linkage elements. Therefore, the user will be able to more easily obtain a standing position from a seat which has a higher elevation.

Figure 5A:
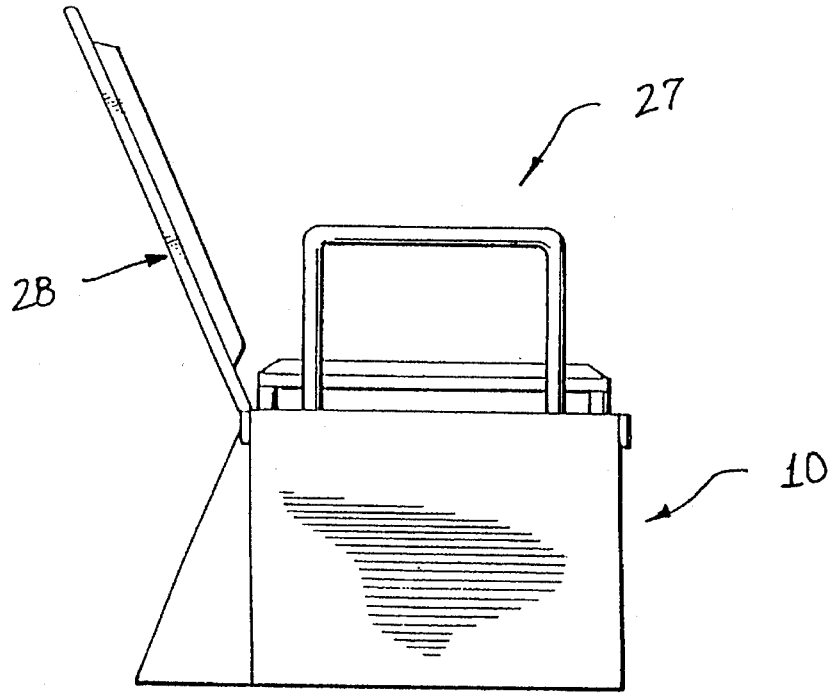
FIG. 5A is a side view of one embodiment of the mechanical uplift assembly unit while in a disengaged position.
Figure 5B:
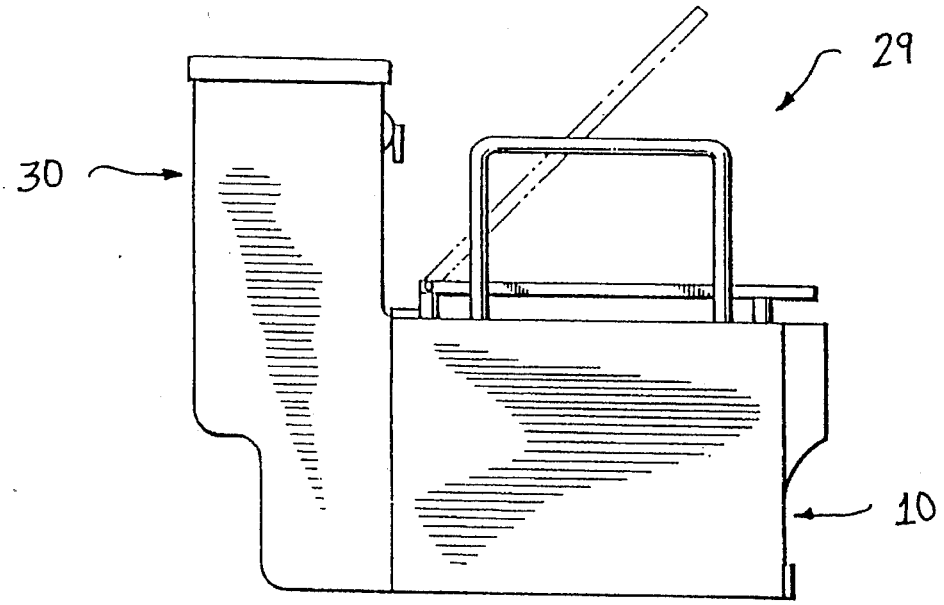
FIG. 5B is a side view of a typical toilet structural incorporating the manually operated uplift apparatus.
Figure 5C:
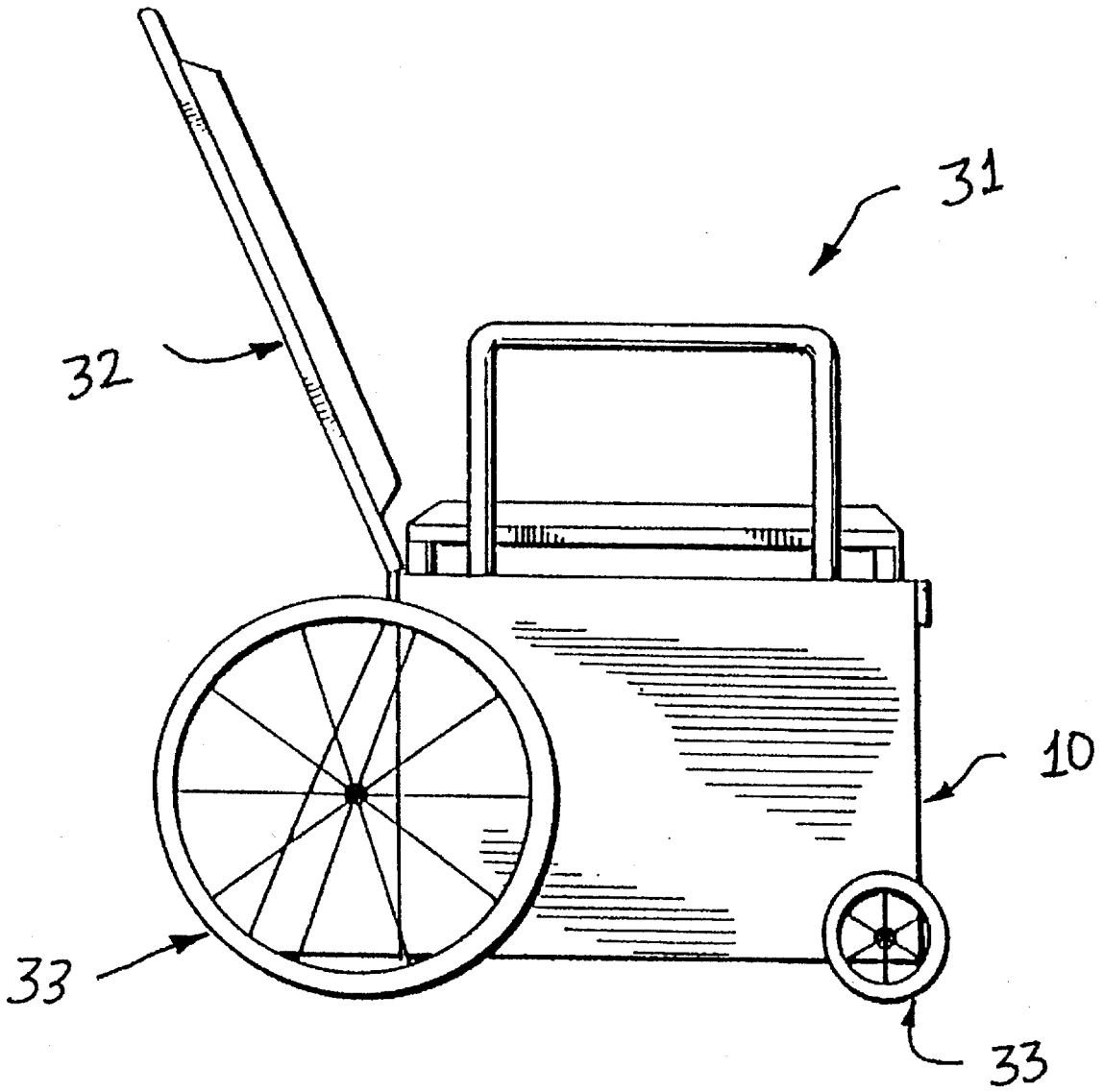
FIG. 5C is a side view of a typical wheelchair structure incorporating the manually operated uplift apparatus.

As can be seen in FIGS. 5A–5C, the instant apparatus may be incorporated into sitting devices of various types, thereby allowing users of these types of devices to benefit from the advantages of the present invention. Optional attachments appropriate to the use of these sitting devices may be further attached, such as wheels 33 in the wheelchair 31, toilet tank 30 in toilet 29, and cushions in chair 27.

It is to be understood that the present invention is not limited to the sole embodiment described above, but encompasses any and all embodiments within the scope of the following claims.

I claim:

1. A manually operated uplift apparatus comprising;

a frame a substantially horizontal seat moveable in a substantially vertical direction with respect to said frame, with said seat maintaining a substantially horizontal position while moving in the substantially vertical direction;

a substantially horizontal hand engagement handle for receiving a downward force from the user, said hand engagement handle moveable independently of said seat in the substantially vertical direction with respect to said frame, with said hand engagement handle maintaining a substantially horizontal position while moving in the substantially vertical direction;

a power translating mechanism operatively connected between said seat, said hand engagement handle, and said frame for translating the downward force applied by the user on said hand engagement handle into an upward force on the seat, thereby assisting the user into a raised position.

2. The manually operated uplift apparatus as claimed in claim 1, said seat being mounted to a first member, and said hand engagement handle being mounted to a second member.

3. The manually operated uplift apparatus as claimed in claim 2, said first member comprising;

at least one elongated seat support member connected to and extending downward from said seat and being coupled to said frame to move in a substantially vertical direction, said seat support member being connected to said power translating mechanism.

4. The manually operated uplift apparatus as claimed in claim 3, the frame comprising at least one guide member adapted to receive said seat support member and guiding said seat support member to move in a substantially vertical direction with respect to said frame.

5. The manually operated uplift apparatus as claimed in claim 4, said guide member including a vertically extending tube section to contain and guide said elongated seat support member as it slides along a portion of its length.

6. The manually operated uplift apparatus as claimed in claim 2, the second member comprising;

at least one elongated handle support member connected to and extending downward from said hand engagement handle and coupled to said frame to move in a substantially vertical direction, said handle support member being connected to said power translating mechanism.

7. The manually operated uplift apparatus as claimed in claim 6, said frame comprising at least one guide adapted to receive said handle support member and guide said handle support member in a substantially vertical direction with respect to said frame.

8. The manually operated uplift apparatus as claimed in claim 7, said guide including a vertically extending tube section to contain and guide said elongated handle support member as it slides along a portion of its length.

9. The manually operated uplift apparatus as claimed in claim 2, said power translating mechanism comprising;

at least one lever pivotally mounted on said frame, said first member operatively connected with one end of said lever and said second member operatively connected with the other end of said lever so that a downward force on said hand engagement handle forces said seat upwardly.

10. The manually operated uplift apparatus as claimed in claim 9, said power translating mechanism further comprising at least one additional lever pivotally mounted on said frame and operatively connecting said first and second members at a different location, said additional lever being used to transfer force and also used to assist in guiding said first and second members in a substantially vertical direction.

11. The manually operated uplift apparatus as claimed in claim 1, said seat being substantially planar.

* * * * *